US009989024B2

(12) United States Patent
Franke

(10) Patent No.: US 9,989,024 B2
(45) Date of Patent: Jun. 5, 2018

(54) FUEL DELIVERY ASSEMBLY

(71) Applicant: Ford Global Technologies, LLC, Dearborn, MI (US)

(72) Inventor: Andreas Franke, Solingen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/161,102

(22) Filed: May 20, 2016

(65) Prior Publication Data

US 2016/0341161 A1 Nov. 24, 2016

(30) Foreign Application Priority Data

May 22, 2015 (DE) ..... 10 2015 209 411

(51) Int. Cl.
*F02M 37/00* (2006.01)
*F02M 37/22* (2006.01)
*F02M 37/10* (2006.01)

(52) U.S. Cl.
CPC ..... *F02M 37/22* (2013.01); *F02M 37/106* (2013.01); *F02M 2037/225* (2013.01); *F02M 2037/228* (2013.01); *Y10T 137/8085* (2015.04)

(58) Field of Classification Search
CPC . F02M 37/22; F02M 37/106; Y10T 137/8085
See application file for complete search history.

(56) References Cited

U.S. PATENT DOCUMENTS 1,617,868 A * 2/1927 Skaggs ..... B60K 15/06 137/266
3,020,950 A * 2/1962 Schraivogel ..... B60K 15/077 137/549
3,622,004 A * 11/1971 Meyer ..... B01D 29/114 210/134
5,875,816 A * 3/1999 Frank ..... B01D 35/0273 123/510
5,951,050 A * 9/1999 Siekmann ..... B60K 15/077 137/256
6,098,652 A * 8/2000 Brandt ..... F02M 37/22 137/115.27
6,640,832 B2 * 11/2003 Walter ..... B60K 15/077 137/565.01
6,948,511 B2 * 9/2005 Taurel ..... B60K 15/03177 123/509
7,861,695 B2 1/2011 Althof et al.
7,980,227 B2 7/2011 Eck et al.
7,992,546 B2 8/2011 Eck et al.
(Continued)

FOREIGN PATENT DOCUMENTS

DE 10355309 A1 6/2005
DE 102006032099 A1 1/2008
DE 102006032101 A1 1/2008

*Primary Examiner* — Craig Schneider
*Assistant Examiner* — Kevin Barss
(74) *Attorney, Agent, or Firm* — Julia Voutyras; McCoy Russell LLP

(57) ABSTRACT

A fuel delivery assembly in an engine is provided herein. The fuel delivery assembly includes a surge pot including a housing with an inner wall enclosing fuel during engine operation, a fuel pump submerged within the fuel, the fuel pump including an inlet receiving fuel from the surge pot, and a fuel filter receiving fuel from an outlet of the fuel pump and positioned external to the inner wall.

12 Claims, 4 Drawing Sheets

(56) References Cited

U.S. PATENT DOCUMENTS

| | | | | |
|---|---|---|---|---|
| 2006/0070941 | A1* | 4/2006 | Cline | B01D 35/0276 210/416.4 |
| 2008/0127948 | A1* | 6/2008 | Braun | B60K 15/077 123/510 |
| 2011/0239993 | A1* | 10/2011 | Powell | F02M 37/106 123/497 |
| 2013/0276531 | A1* | 10/2013 | Benner | B60K 15/03 73/290 R |
| 2014/0224216 | A1* | 8/2014 | Coachman | F02D 33/003 123/446 |

* cited by examiner

FUEL DELIVERY ASSEMBLY

CROSS REFERENCE TO RELATED APPLICATION

This application claims priority to German Patent Application No. 102015209411.1, filed May 22, 2015, the entire contents of which are hereby incorporated by reference for all purposes.

BACKGROUND/SUMMARY

Many modern vehicles have a fuel filter integrated in the tank module. In some designs the fuel filter is arranged either below a tank module flange (e.g., donut design) or in the surge pot as a separate filter cartridge. These fuel filters with limited filter capacity are not however exchangeable. In markets in which the fuels may contain contaminants, the filter capacity is reached so quickly that the entire module must be replaced.

DE 10 2006 032 101 A1 describes a delivery unit or assembly for delivering fuel in a fuel tank of a motor vehicle with a surge pot for collecting fuel and a prefilter. According to DE 10 2006 032 101 A1, the prefilter is arranged inside the surge pot and connected to the surge pot by material fit or produced integrally with the surge pot. The prefilter is situated inside the surge pot and cannot be removed or replaced without disassemblying the entire delivery unit. As a result, filter replacement may be impractical or very time consuming and costly.

DE 10 2006 032 099 A1 discloses a delivery unit or assembly for delivering fuel from a fuel tank of a motor vehicle with a surge pot for collecting fuel, wherein a fuel pump is provided which aspirates fuel from the surge pot. Furthermore, downstream of the fuel pump in the fuel flow direction, a fine filter is provided for filtering the fuel. Due to the fine filter position within an internal chamber of the assembly the fine filter cannot be removed or replaced without disassembling the entire delivery unit.

As such in one approach, a fuel delivery assembly in an engine is provided herein. The fuel delivery assembly includes a surge pot including a housing with an inner wall enclosing fuel during engine operation, a fuel pump submerged within the fuel, the fuel pump including an inlet receiving fuel from the surge pot, and a fuel filter receiving fuel from an outlet of the fuel pump and positioned external to the inner wall.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
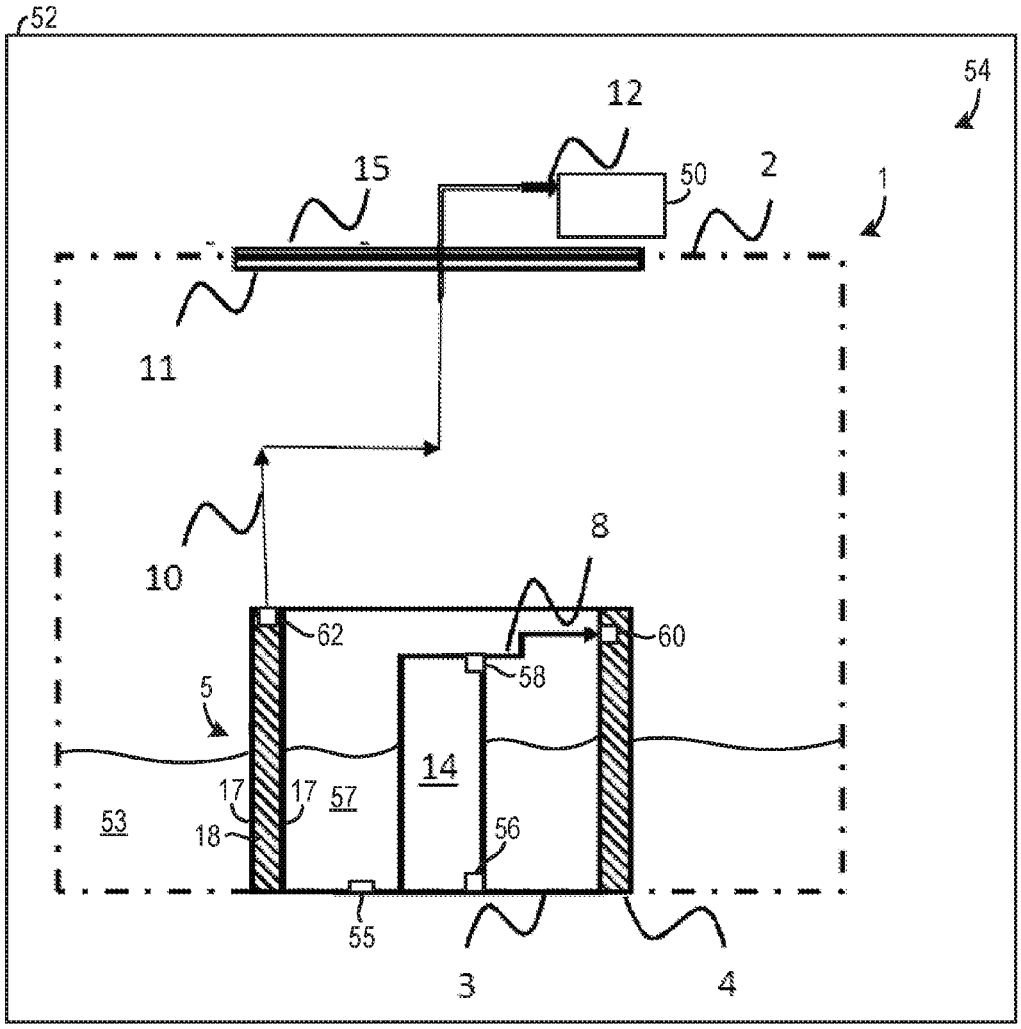
FIG. 1 shows a cross-sectional view of a fuel delivery assembly according to a first exemplary embodiment.

The present description relates to a fuel delivery assembly for delivering fuel in a fuel tank of a motor vehicle with a surge pot for collecting fuel and with a fuel filter. The fuel delivery assembly may be included in an engine of a motor vehicle.

In one example, the fuel delivery assembly includes a fuel filter is arranged in an outer portion of a surge pot and wherein the filter is configured forming an outer portion of the surge pot. In one embodiment, it is conceivable that the filter housing replaces the surge pot.

It is pointed out that in the description which follows, features and measures listed individually may be combined with each other in any arbitrary, technically sensible manner and disclose further embodiments of the fuel delivery assembly.

By arranging the fuel filter in an outer portion of the surge pot, the space required for the fuel filter is reduced since, in comparison with an arrangement of the fuel filter on a tank module flange (donut design,) it is possible to configure the fuel tank with a smaller internal height, if desired. A fuel filter is a component in motor vehicles which removes solid particles from the fuel. The fuel filter may be filled with a paper-like filter material which is received in a filter housing of the fuel filter, in one example. However, other types of filter materials have been contemplated. Further in some examples where the vehicles has space constraints, the fuel filter can thus be formed with a flexible material to the construction space available and the useful volume of the fuel tank and hence the range increased, since there is no separate filter cartridge reducing the useful volume of the fuel container and no space is needed for arranging the fuel filter on the flange.

In another example, the fuel filter may be formed cylindrical or as part of a cylinder. Thus the fuel filter (e.g., the filter housing and/or filter material) may have a form which is simple to produce. The fuel can be guided through the casing surface and/or the end faces of the fuel filter in order to be filtered.

In another example, the fuel filter (e.g., the filter housing and/or the filter material) is formed as a hollow cylinder. This allows the fuel to be filtered to collect inside the hollow cylinder and be transported from there. Thus the fuel filter formed as a hollow cylinder has a large filter inlet area with simultaneously low volume, which further reduces the construction space required. In this way, the fuel delivery assembly only slightly reduces the useful volume of the fuel tank.

In another example, the fuel filter (e.g., the filter housing and/or the filter material) may form an outer portion of the surge pot. Thus the fuel filter replaces a portion of the outer wall of the surge pot, so that fuel passes through the inlet face of the fuel filter formed, for example as an end face, through the fuel filter to the outlet face of the fuel filter also formed, for example as an end face, whence it can enter the inside of the surge pot. By replacing part of the outer wall of the surge pot, the material consumption for producing the surge pot is reduced and hence also its weight.

In another example, the fuel filter and surge pot are formed integrally. The filter housing and the surge pot, or the filter material and the surge pot, may be formed integrally. Thus the surge pot with the fuel filter can form a compact assembly.

In another example, the fuel filter (e.g., the filter housing and/or the filter material) is releasably connected to the surge pot. This allows a simple exchange of the fuel filter when the filter capacity is for example exhausted (e.g., due to operation with correspondingly contaminated fuel). For this, either the filter housing with the exhausted filter material or just the filter material is replaced.

In another example, the surge pot has a filter enclosure in which the filter material of the fuel filter is received. The filter enclosure may replace the filter housing so that the filter material without filter housing can be received in the filter enclosure. This allows secure fixing of the filter material in the filter enclosure and at the same time a design of the fuel delivery assembly requiring particularly little construction space, so that the fuel delivery assembly only slightly reduces the useful volume of the fuel tank, if desired.

In another example, the fuel delivery assembly may additionally include a releasable fuel line coupling releasably coupled to the fuel filter and a fuel line extending between an outlet of a fuel pump and the fuel filter, the fuel pump arranged in the surge pot. The releasable fuel line coupling facilitates an exchange of the fuel filter.

In another example, the fuel delivery assembly may additionally include a second releasable fuel line coupling attached to an outlet of the fuel filter, the second releasable fuel line coupling attached to a second fuel line providing fuel to downstream engine components. The second releasable fuel line coupling further facilitates an exchange of the fuel filter.

FIG. 1 shows a fuel delivery assembly 1 for delivering fuel in a fuel tank 2 to an engine 50 of a motor vehicle 52. The fuel tank 2 encloses fuel 53 (e.g., gasoline, diesel, alcohol, etc.). The fuel delivery assembly 1 may be included in fuel delivery system 54. In one example, the motor vehicle 52 may be a motor vehicle that has space constraints in the fuel delivery system.

In the present exemplary embodiment, the fuel delivery assembly 1 has a surge pot 3 for collecting fuel. The surge pot 3 includes an inlet 55 configured to receive fuel from the fuel tank 2. Although the inlet 55 of the surge pot 3 is position on a lower side of the surge pot 3 other positions of the surge pot inlet have been contemplated. The surge pot 3 has cylindrical shape in the depicted example. However in other examples, the surge pot 3 may have another suitable geometry adapted to space constraints of the fuel tank 2.

A fuel pump 14 is arranged inside the surge pot 3. The fuel pump 14 aspirates the fuel collected from surge pot 3 through an inlet 56 of the fuel pump 14. Thus, the surge pot 3 houses a volume of fuel 57. The fuel pump 14 also includes an outlet 58 delivering fuel to a first fuel line 8. The first fuel line 8 is also coupled to an inlet 60 of the fuel filter 4. In the present exemplary embodiment, the fuel filter 4 is arranged downstream of the fuel pump 14 in the fuel flow direction. The first fuel line 8 extends through the surge pot 3. It will be appreciated fuel in the first fuel line 8 remains fluidly separated from fuel in the surge pot 3. Specifically in the embodiment shown in FIG. 1, the first fuel line 8 is enclosed within the surge pot 3.

A second fuel line 10 creates a fluidic connection from the fuel filter 4 (e.g., an outlet 62 of the fuel filter 4) to an engine connection assembly 12. The engine connection assembly 12 is coupled to the engine 50 and provides fuel thereto. It will be appreciated that conduits, valves, etc., may be provided to enable the engine connection assembly 12 to flow fuel to the engine 50.

In the present exemplary embodiment, the second fuel line 10 extends through a flange 11 of the fuel tank 2 for fixing a fuel tank cover 15 which closes the fuel tank 2.

The fuel filter 4 is configured to remove solid particles from fuel. In the present exemplary embodiment, the fuel filter 4 has a filter housing 17 which is filled with a filter material 18.

Additionally in the present exemplary embodiment, the filter housing 17 of the fuel filter 4 forms at least one outer portion 5 of the cylindrical surge pot 3, namely its casing face. The fuel filter 4 may also perform the function of the surge pot casing face over the entire periphery. Thus the fuel filter 4 can also be formed with a cylindrical shape. Thus in the present exemplary embodiment, the fuel filter 4 is formed as a hollow cylinder, wherein the surge pot 3 with the fuel pump 14 arranged therein is formed in the interior of the hollow cylinder. However, other fuel filter geometries have been contemplated.

Furthermore, in the present exemplary embodiment, the surge pot 3 and the fuel filter 4, and specifically the filter housing 17 are formed integrally. Thus the fuel filter 4 is fluidly connected to the surge pot 3. However the surge pot 3 and the fuel filter 4 may also be formed separately from each other.

In operation, the fuel pump 14 aspirates the fuel which has collected in the surge pot 2 from the fuel tank 2. Specifically, the surge pot 2 includes an inlet 55. Additionally, the fuel pump 14 includes an inlet 56 receiving fuel from the surge pot 2 and an outlet 58 delivering fuel to the first fuel line 8. The first fuel line 8 delivers fuel to an inlet 60 of the fuel filter 4 in which the fuel is filtered. The fuel is then delivered from the fuel filter 4, at an outlet 62 of the fuel filter 4, through the second fuel line 10 passing through the flange 11 and/or fuel tank cover 15, to the engine connection assembly 12 where it is fed into the line system of the motor vehicle.

By arranging the fuel filter 4 on the outside of the surge pot 3, no installation space is required for an arrangement of the fuel filter 4 on the flange 11, if desired. Thus the fuel filter 4 may have a reduced internal height. Also, by arranging the fuel filter 4 on the outside of the surge pot 3, the useful volume of the fuel tank 2 is reduced less than if the fuel filter 4 were formed as a separate filter cartridge arranged next to the surge pot 3 in the interior of the fuel tank 2.

A fill level sensor system (not shown) may be arranged on the outside of the fuel filter 4 (e.g., the filter housing 17) or on its outer portion 5, for detecting the fill level in the fuel tank 2. Also, further components such as connecting rods (not shown) may be arranged on the filter housing 17. Furthermore, an electrically conductive connection to the vehicle ground can be created via a connecting rod to dissipate electrical charges.

Figure 2:
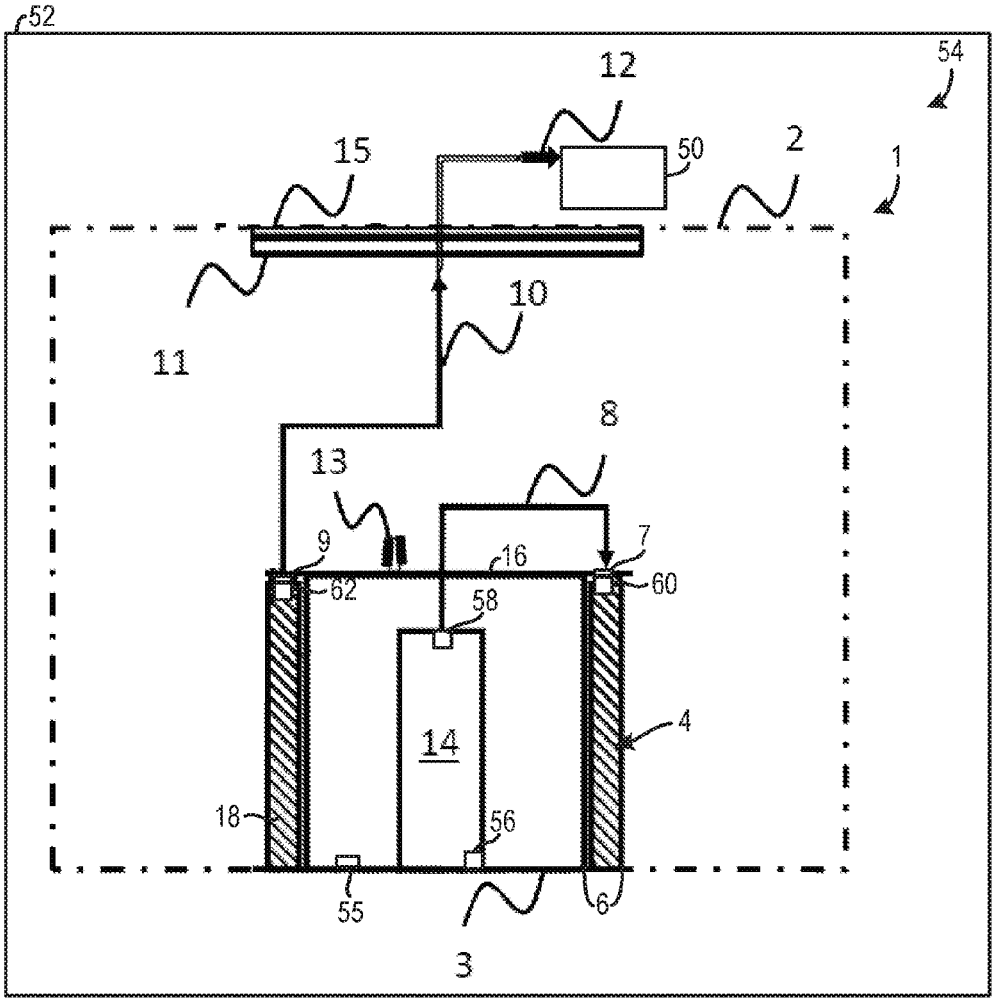
FIG. 2 shows a cross-sectional view of a fuel delivery assembly according to a second exemplary embodiment.

The second exemplary embodiment according to FIG. 2 differs from the first exemplary embodiment in FIG. 1 in that the surge pot 3 comprises a filter enclosure 6 in which the fuel filter 4 is received. The filter housing 17 of the fuel filter 4 may be releasably connected to the surge pot 3. Thus the fuel filter 4 may be separated from the surge pot 3 and exchanged. By deviation from the present exemplary embodiment, the filter enclosure 6 may also be configured to receive the filter material 18 without the filter housing 17. In this case, the filter enclosure 6 replaces the filter housing 17 and it is possible to exchange just the filter material 18. In other words, in this exemplary embodiment, the filter enclosure 6 and the filter material 18 form the fuel filter 4.

To facilitate exchange of the fuel filter 4, in the present exemplary embodiment a first releasable fuel line coupling 7 is provided for coupling the first fuel line 8. Also, in the present exemplary embodiment, a second releasable fuel line coupling 9 is provided for coupling the second fuel line 10. Furthermore, in the present exemplary embodiment, a locking mechanism 13 is provided which fixes a surge pot cover 16 closing the surge pot 3.

If the fuel filter 4 is clogged and must be replaced, first the fuel tank cover 15 is removed from the fuel tank 2.

In another filter replacement step, the first fuel line coupling 7 and the second fuel line coupling 9 are then each opened so that the first fuel line 8 and the second fuel line 10 are separated from the fuel filter 4. After the locking mechanism 13 has been opened, the surge pot cover 16 can also be removed and the fuel filter 4 with filter housing 17 and filter material 18, or just the filter material 18, may be removed from the filter enclosure 6.

After a new fuel filter 4 or new fuel filter material 18 has been placed in the filter enclosure 6, the first fuel line coupling 7 and the second fuel line coupling 9, with the first fuel line 8 and the second fuel line 10 respectively, are each connected again fuel-conductively to the fuel filter 4. The surge pot cover 16 is then repositioned and fixed with the locking mechanism 13. Finally, the fuel tank cover 15 is refitted on the fuel tank 2 and the fuel tank 2 is thus closed again. In this way, the fuel filter 4 can be quickly and easily replaced.

A fuel delivery assembly 1 is thus produced in which a clogged fuel filter 4 can be exchanged without exchanging the surge pot 3. Furthermore, by arranging the fuel filter 4 on the outside of the surge pot 3, here again no construction space is needed for arranging the fuel filter 4 on the flange 11, so that the fuel tank 2 may have a smaller internal height, if desired. This allows the fuel tank 2 to be adapted flexibly to the space available. Furthermore, the useful volume of the fuel tank 2 is thus reduced less than if the fuel filter 4 were configured as a separate filter cartridge arranged above the surge pot 3 (e.g., on the flange 11) in the interior of the fuel tank 2. Thus the useful volume of the fuel tank can be enlarged can be enlarged, if desired, enabling the vehicle's range to be extended.

Figure 3:
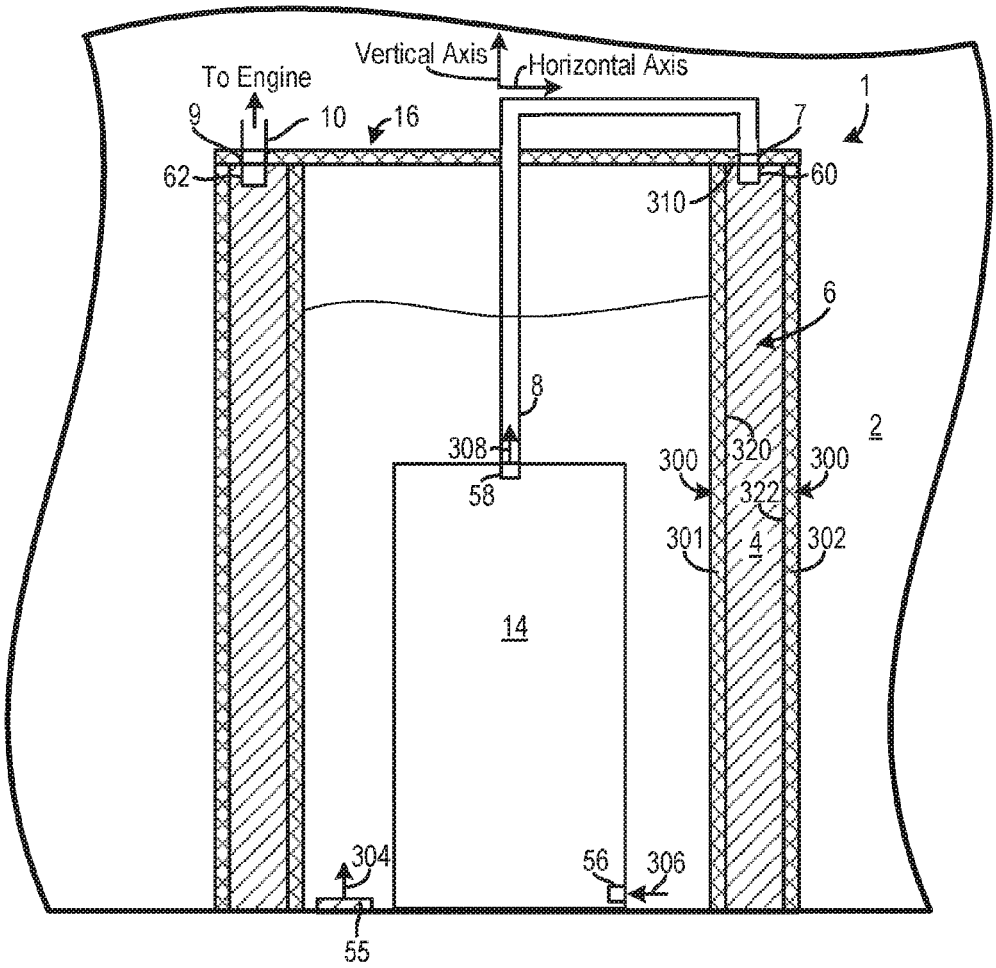
FIG. 3 shows a detailed cross-sectional view of the fuel delivery assembly shown in FIG. 2.

FIG. 3 shows a detailed embodiment of the fuel delivery assembly 1 shown in FIG. 2. The fuel pump 14 enclosed within the surge pot 3 is shown in FIG. 3. The surge pot 3 houses a volume of fuel. The inlet 55 of the surge pot 3 is also depicted. Arrow 304 denotes the general flow of fuel from the fuel tank 2 into the surge pot 3 through the inlet 55. Thus, the fuel tank 2 also houses a volume of fuel.

The inlet 56 and outlet 58 of the fuel pump 14 are also shown in FIG. 3. Arrow 306 depicts the general direction of fuel flow into the inlet 56 of the fuel pump 14 from the surge pot 3. Additionally, arrow 308 depicts the general direction of fuel flow from the outlet 58 of the fuel pump 14 and into fuel line 8. As illustrated, the fuel line 8 extends (e.g., vertically extends) through the surge pot 3. Specifically the fuel line 8 extends through the surge pot cover 16 and connects to the inlet 60 of the fuel filter 4. In other examples, the fuel line 8 may horizontally extend across the surge pot 3. The first releasable fuel line coupling 7 is provided in the fuel delivery assembly 1 to enable the fuel line 8 to be easily disconnected from the inlet 60 of the fuel filter 4.

The outlet 62 of the fuel filter 4 is also shown in FIG. 3. It will be appreciated that fuel may circumferentially flow from the inlet 60 to the outlet 62 of the fuel filter 4. Additionally in other examples, fuel may flow vertically through the fuel filter 4 when the outlet 62 is positioned vertically above the inlet 60. The second releasable fuel line coupling 9 coupled to the outlet 62 enables the fuel line 10 to be easily disconnected from the fuel filter 4. In one example, the releasable fuel line coupling may be attached/detached via tools such as wrenches, screw drivers, etc., or in other instances without the use of tools.

The surge pot 3 includes a housing 300 with an inner wall 301 and an outer wall 302. The inner wall 301 separates the fuel filter 4 from the fuel in the surge pot 3. On the other hand, the outer wall 302 separates the fuel filter 4 from the fuel in the fuel tank 2. The inner wall 301 is parallel to the outer wall 302, in the depicted example. This enables the fuel filter 4 to be easily placed in the filter enclosure 6. However, other surge pot wall geometries have been contemplated.

Additionally, the inner wall 301 circumferentially surrounds the fuel pump 14 and the outer wall 302 circumferentially surrounds the fuel filter 4. Specifically, the inner wall 301 and the outer wall 302 define a portion of a boundary of the filter enclosure 6 (i.e., the cavity which receives the removable filter material.) Specifically, a surface 320 of the inner wall 301 and a surface 322 of the outer wall 302 define the portion of the boundary of the filter enclosure 6.

The surge pot cover 16 is also shown in FIG. 3. As discussed above the surge pot cover 16 is releasably attached to the surge pot 3. An interior surface 310 of the surge pot cover 16 defines another portion of the boundary of the filter enclosure 6.

Figure 4:
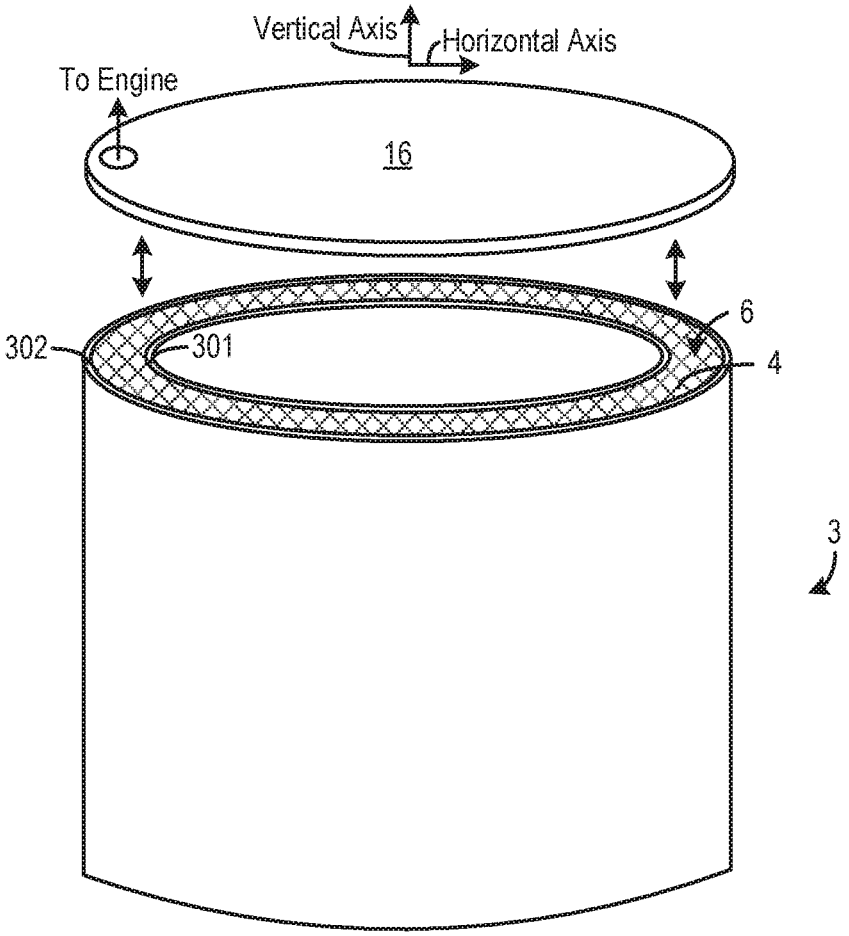
FIG. 4 shows a perspective view of the surge pot and the fuel filter in the fuel delivery assembly shown in FIG. 3.

FIG. 4 shows a perspective view of the surge pot 3 and the fuel filter 4 shown in FIG. 3 with the surge pot cover 16 detached from the surge pot 2. It will be appreciated that the surge pot cover 16 may be detached from the surge pot 3 when replacement of the fuel filter 4 is desired. The view in FIG. 4 clearly shows the cylindrical shape of the surge pot 3 and the fuel filter 4. Specifically, the fuel filter 4 has an annular shape in a horizontal cross-section which can simplify replacement and manufacturing of the filter. The inner wall 301 and the outer wall 302 defining sections of the boundary of the filter enclosure 6 are also illustrated.

The subject matter of the present disclosure is further described in the following paragraphs. According to one aspect, a fuel delivery assembly in an engine is provided. The fuel delivery assembly includes a surge pot including a housing with a wall enclosing fuel during engine operation, a fuel pump submerged within the fuel, the fuel pump including an inlet receiving fuel from the surge pot, and a fuel filter receiving fuel from an outlet of the fuel pump and positioned external to the wall.

According to another aspect, a fuel delivery assembly in a fuel delivery system of an engine is provided. The fuel delivery assembly includes a surge pot including a housing with an inner wall enclosing fuel during engine operation, a fuel pump circumferentially enclosed by the inner wall, the fuel pump including an inlet receiving fuel from the surge pot, a fuel filter receiving fuel from an outlet of the fuel pump and positioned external to the inner wall, and a fuel line extending from the outlet of the fuel pump to the fuel filter through the surge pot, the fuel line being fluidly separated from fuel in the surge pot.

In any of the aspects described herein or combinations of the aspects, the fuel filter may have a cylindrical shape.

In any of the aspects described herein or combinations of the aspects, the fuel filter may be formed as a hollow cylinder with an annular shape in a horizontal cross-section.

In any of the aspects described herein or combinations of the aspects, the fuel filter may circumferentially surround the wall of the surge pot.

In any of the aspects described herein or combinations of the aspects, the fuel filter may be integrated into the surge pot.

In any of the aspects described herein or combinations of the aspects, the fuel filter may be releasably connected to the surge pot.

In any of the aspects described herein or combinations of the aspects, the surge pot may have a filter enclosure in which filter material of the fuel filter is received, a boundary of the filter enclosure defined by the wall and an outer wall of the surge pot.

In any of the aspects described herein or combinations of the aspects, the fuel delivery assembly may further include a releasable fuel line coupling releasably coupled to the fuel filter and a fuel line extending between an outlet of a fuel pump and the fuel filter, the fuel pump arranged in the surge pot.

In any of the aspects described herein or combinations of the aspects, the fuel delivery assembly may further include a second releasable fuel line coupling attached to an outlet of the fuel filter, the second releasable fuel line coupling attached to a second fuel line providing fuel to downstream engine components.

In any of the aspects described herein or combinations of the aspects, the fuel filter may be positioned in a filter enclosure between an outer wall of the surge pot and the inner wall.

In any of the aspects described herein or combinations of the aspects, the inner wall and the outer wall may define a portion of a boundary of the filter enclosure.

In any of the aspects described herein or combinations of the aspects, the fuel delivery assembly may further include a surge pot cover releasably attached to the surge pot, an interior surface of the surge pot cover defining a second portion of the boundary of the filter enclosure.

In any of the aspects described herein or combinations of the aspects, the fuel line may extend into the fuel tank.

In any of the aspects described herein or combinations of the aspects, fuel may flow in a circumferential direction through the fuel filter.

In any of the aspects described herein or combinations of the aspects, the fuel filter may have an annular shape in a horizontal cross-section.

In any of the aspects described herein or combinations of the aspects, the surge pot may be positioned within a fuel tank.

In any of the aspects described herein or combinations of the aspects, the outer wall may fluidly separate the fuel filter from the fuel tank.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A fuel delivery assembly in a fuel delivery system of an engine, comprising:

a surge pot including a housing with an inner wall enclosing fuel during engine operation;

a fuel pump circumferentially enclosed by the inner wall, the fuel pump including an inlet receiving fuel from the surge pot;

a fuel filter receiving fuel from an outlet of the fuel pump and positioned external to the inner wall; and a fuel line extending from the outlet of the fuel pump to the fuel filter through the surge pot, the fuel line being fluidly separated from fuel in the surge pot;

where the fuel filter is positioned in a filter enclosure between an outer wall of the surge pot and the inner wall.

2. The fuel delivery assembly of claim 1, where the inner wall and the outer wall define a portion of a boundary of the filter enclosure.

3. The fuel delivery assembly of claim 2, further comprising a surge pot cover releasably attached to the surge pot, an interior surface of the surge pot cover defining a second portion of the boundary of the filter enclosure.

4. The fuel delivery assembly of claim 1, where the fuel line extends into a fuel tank.

5. The fuel delivery assembly of claim 1, where fuel flows in a circumferential direction through the fuel filter.

6. The fuel delivery assembly of claim 1, where the fuel filter has an annular shape in a horizontal cross-section.

7. The fuel delivery assembly of claim 1, where the surge pot is positioned within a fuel tank.

8. The fuel delivery assembly of claim 1, where the outer wall fluidly separates the fuel filter from a fuel tank.

9. The fuel delivery assembly of claim 1, where the fuel filter circumferentially surrounds the inner wall of the surge pot.

10. The fuel delivery assembly of claim 1, where the fuel filter is releasably connected to the surge pot.

11. The fuel delivery assembly of claim 1, further comprising a first releasable fuel line coupling releasably coupled to the fuel filter and the fuel line.

12. The fuel delivery assembly of claim 11, further comprising a second releasable fuel line coupling attached to an outlet of the fuel filter, the second releasable fuel line coupling attached to a second fuel line providing fuel to downstream engine components.

* * * * *